United States Patent [19]

Onomura et al.

[11] Patent Number: 4,752,191

[45] Date of Patent: Jun. 21, 1988

[54] SHOE-AND-SOCKET JOINT BETWEEN SWASH PLATE AND PISTON OF SWASH PLATE TYPE COMPRESSOR

[75] Inventors: Hiroshi Onomura; Satoshi Kitahama; Hayato Ikeda, all of Kariya, Japan

[73] Assignee: Kabushiki Kaisha Toyoda Jidoshokki Seisakusho, Aichi, Japan

[21] Appl. No.: 86,926

[22] Filed: Aug. 18, 1987

Related U.S. Application Data

[63] Continuation-in-part of Ser. No. 67,636, Jun. 26, 1987.

[30] Foreign Application Priority Data

Aug. 25, 1986 [JP] Japan ..... 61-129062[U]

[51] Int. Cl.[4] ..... F04B 1/16; F04H 1/18; F01B 3/00

[52] U.S. Cl. ..... 417/269; 92/71; 74/60

[58] Field of Search ..... 417/269; 92/71; 74/60

[56] References Cited

U.S. PATENT DOCUMENTS 4,662,267 5/1987 Kaku et al. ..... 417/269
4,683,803 8/1987 Miller et al. ..... 417/269
4,683,804 8/1987 Futamura et al. ..... 417/269

FOREIGN PATENT DOCUMENTS 135990 6/1986 Japan ..... 417/222

*Primary Examiner*—William L. Freeh
*Attorney, Agent, or Firm*—Burgess, Ryan & Wayne

[57] ABSTRACT

A shoe-and-socket joint, which is incorporated into a swash plate type compressor as a drive force transmitting unit arranged between a rotational swash plate and each of a plurality of reciprocal pistons, has a shoe provided with a spherically formed contact face and a recessed curved socket, for example, an ellipsoidal socket, deviated from a spherical form. Therefore, there is provided a wedge-shaped clearance between the socket and the shoe. An oil containing refrigerant gas flows enough into between the socket and the shoe to achieve a good lubrication.

9 Claims, 3 Drawing Sheets

SHOE-AND-SOCKET JOINT BETWEEN SWASH PLATE AND PISTON OF SWASH PLATE TYPE COMPRESSOR

This is continuation-in-part of the pending U.S. patent application Ser. No. 067,636 filed on June 26, 1987, having the same assignee as that of the present application.

BACKGROUND OF THE INVENTION

1. Field of the Invention

The present invention relates to a swash plate type compressor for use in an air-conditioning system for vehicles, and in particular, to an improved structure of a shoe-and-socket joint between a swash plate and a piston of a swash plate type compressor for providing sliding contact surfaces of the shoe and the socket of the piston with a better lubrication by the oil-contained refrigerant.

2. Description of the Related Art

A typical swash plate type compressor is disclosed in, for example, U.S. Pat. No. 4,329,913 of Nakayama et al. The compressor has a pair of horizontally axially aligned cylinder blocks which form a combined cylinder block. Axially extending cylinder bores and a swash plate chamber receiving a swash plate therein are formed inside the combined block, and the combined cylinder block is closed at both ends by front and rear housings, via valve plates. A drive shaft passes through the center of the combined block, and is rotatably supported by suitable radial and thrust bearing. The swash plate is fixed at the middle of the drive shaft and is operatively connected, via ball bearings and shoes, to double-headed pistons slidably fitted in the cylinder bores. Thus, the rotating motion of the swash plate within the swash plate chamber causes the reciprocal compression and suction motions of the pistons within the cylinder bores. The front and rear housings are provided with refrigerant suction chambers and refrigerant discharge chambers, which are interconnected with the cylinder bores and are connectable to an outside air-conditioning system by appropriate refrigerant flow pipelines. In other conventional types of swash plate, for example, as disclosed in the pending U.S. patent application Ser. No. 897,550, filed on Aug. 15, 1986, by M. Kato et al, and assigned to the same assignee as the present application, the ball bearings and shoes are replaced with semi-spherical shoes having a spherical contact face arranged in sliding contact with a spherical socket formed in the piston and a flattened contact face opposite to the spherical contact face and in sliding contact with the face of the swash plate.

However, in the above-mentioned conventional swash plate type compressor, the spherical socket of the piston is designed and formed to have substantially the same diameter as that of the ball or spherical face of the semi-spherical shoe, so that a complementary engagement is established between the piston and the ball or semi-spherical shoe. That is, there is almost no clearance between the piston and the ball or semi-spherical shoe. This makes it difficult for the oil-contained refrigerant in the swash plate chamber to flow between the spherical socket of the piston and the ball or semi-spherical shoe, and as a result, a lack of lubrication occurs in the sliding contact surfaces of the ball or semi-spherical shoe and the spherical socket of the piston. Thus, in a long operation of the swash plate type compressor, an abrasion of the both sliding contact surfaces, and in particular, the abrasion at the outer edge of the spherical socket of the piston, occurs. Accordingly, the clearance between the spherical socket of the piston and the ball or semi-spherical shoe increases. Due to this increased clearance, noise is generated by the ball or shoe striking the socket. Further, burning-in between the socket and the ball or shoe occurs due to a relative fast sliding contact.

SUMMRY OF THE INVENTION

An object of the present invention is to permit a sufficient flow of an oil-containing refrigerant into the contacting surfaces between the socket and the shoe during the operation of the swash plate type compressor.

Another object of the present invention is to obviate the noise caused by contact between the socket and the shoe.

A further object of the present invention is to provide a smooth and precise compression motion of the swash plate type compressor.

In accordance with the present invention, there is provided a swash plate type compressor having a refrigerant lubricated shoe-and-socket joint for transmitting an axial force from a rotating swash plate mounted on a drive shaft to a piston of the compressor, which applies an axially reciprocal compression effect to a refrigerant within a cylinder bore of the compressor. The refrigerant lubricated shoe-and-socket joint comprises a shoe having a flat contact face in sliding contact with the swash plate and a spherical body provided with a substantially spherical contact face arranged opposite to the flat contact face, and a socket having a recessed curved face deviated from a spherical face, and an entrance opening with a minor axis and a major axis, which recessed curved face is formed in the piston and is in sliding contact with the substantially spherical contact face of the spherical body of the shoe.

Preferably, the above mentioned recessed curved face is a substantially ellipsoidal face, and preferably, a length of the minor axis is substantially equal to a diameter of the spherical body of the shoe.

BRIEF DESCRIPTION OF THE DRAWINGS

The above and other objects, features and advantages of the present invention will become more apparent from the accompanying drawings wherein.

DESCRIPTION OF THE PREFERRED EMBODIMENTS

Figure 1:
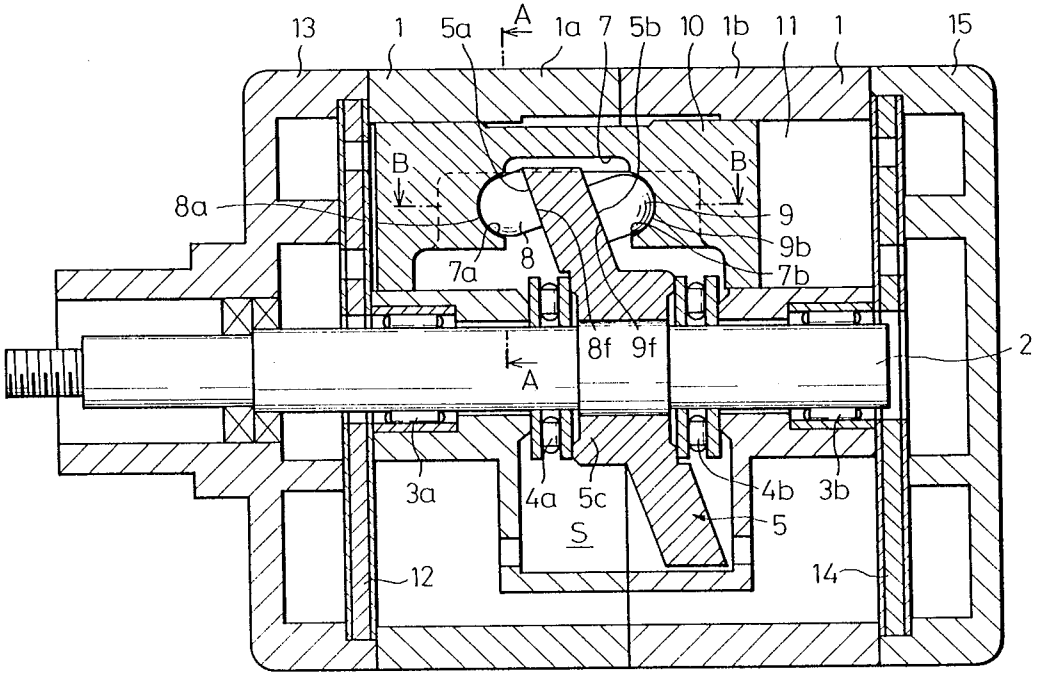
FIG. 1 is a longitudinal cross sectional view of a swash plate type compressor illustrating a general construction of the compressor in which a shoe-and-socket joint according to the present invention is accommodated.

Referring to FIG. 1, illustrating a typical swash plate type compressor for use in a vehicle air-conditioning system, the compressor has a cylinder block 1 formed by combining a front cylinder block 1*a* and a rear cylinder block 1*b*. The cylinder block 1 is provided with axially extending cylinder bores 11 arranged equiangularly in the circumferential direction of the cylinder block 1 and parallel with each other around the center axis of the cylinder block 1. The front end of the cylinder block 1 is closed by a front housing 13, via a valve plate 12, and the rear end of the cylinder block 1 is closed by a rear housing 15, via a valve plate 14. Passing centrally through the cylinder block 1, the front housing 13, and the valve plate 12, a drive shaft 2 is rotatably supported by a front antifriction bearing 3*a* and a rear anti-friction bearing 3*b*, and is provided with a swash plate 5 secured thereon. The swash plate 5 has a central boss portion 5*c* which is axially supported by front and a rear thrust bearings 4*a* and 4*b* intervened between the boss portion 5*c* and the front and rear cylinder blocks 1*a* and 1*b*.

Double-headed pistons 10 are slidably fitted in the respective cylinder bores 11 of the cylinder 1 to carry out a reciprocatory suction and compression of a refrigerant gas containing a lubricating oil component. Each of the pistons 10 has, at the axially central portion thereof, a recess 7 opening toward the center portion of the central axis of the drive shaft 2 and permitting the swash plate 5 to pass therethrough when rotating. The swash plate 5 is provided with two oblique faces 5*a* and 5*b* which are inclined from the vertical plane with respect to the central axis of the drive shaft 2. The swash plate 5 is operatively connected to the respective pistons 10 by a pair of shoes 8 and 9. Each of the shoes 8 and 9 has the shape of a substantially semi-sphere and has a flat contact face 8*f* or 9*f* in contact with one of the oblique faces 5*a* and 5*b* of the swash plate 5 and a spherical contact face 8*a* or 9*b* slidably engaged in one of a pair of axially opposed ellipsoidal faces 7*a* and 7*b* of sockets recessed on each of two end faces axially opposed in the recess 7 of each piston 10. These faces 7*a* and 7*b* may be formed in the shape of another general curved face deviated from an ellipsoidal face and from a spherical face. These sockets respectively have entrance opening 18*a* or 18*b* with a minor axis SA and a major axis LA (see FIGS. 2 and 3).

The swash plate 5 supported on the drive shaft 2 rotates within a swash plate chamber S formed in the center of the cylinder block 1, and the rotation of the swash plate 5 causes the reciprocating motion of the pistons 10 in the cylinder bores 11. The refrigerant gas containing a lubricating oil is returned from the vehicle air-conditioning circuit and enters suction chambers formed in the front and rear housings 13 and 15. The refrigerant gas is then pumped into the cylinder bores 11, due to the sucking operation of the reciprocating pistons 10, and is compressed by the pistons 10 within the cylinder bores 11. The compressed refrigerant is discharged toward discharge chambers formed in the front and rear housings 13 and 15, and is subsequently sent to the outside air-conditioning circuit. During this operation, the oil containing refrigerant passes between the drive shaft 2 and the bearings 3*b*, 4*b* and into the swash plate chamber S.

Figure 2:
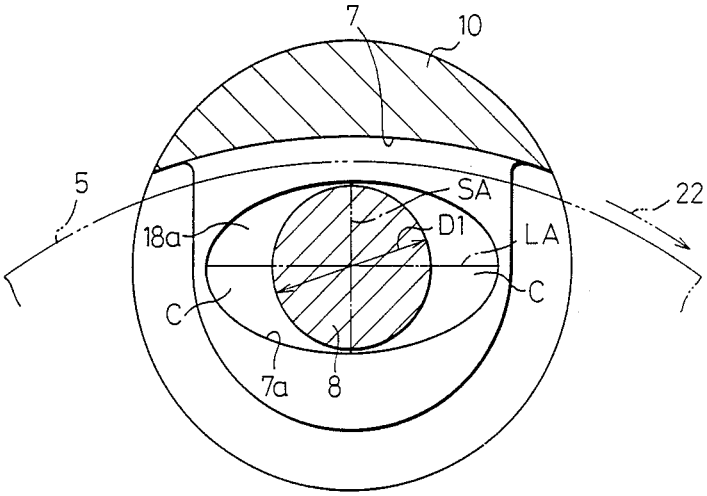
FIG. 2 is an enlarged cross sectional view of the shoe-and-socket joint taken along the line A—A of FIG. 1.
Figure 3:
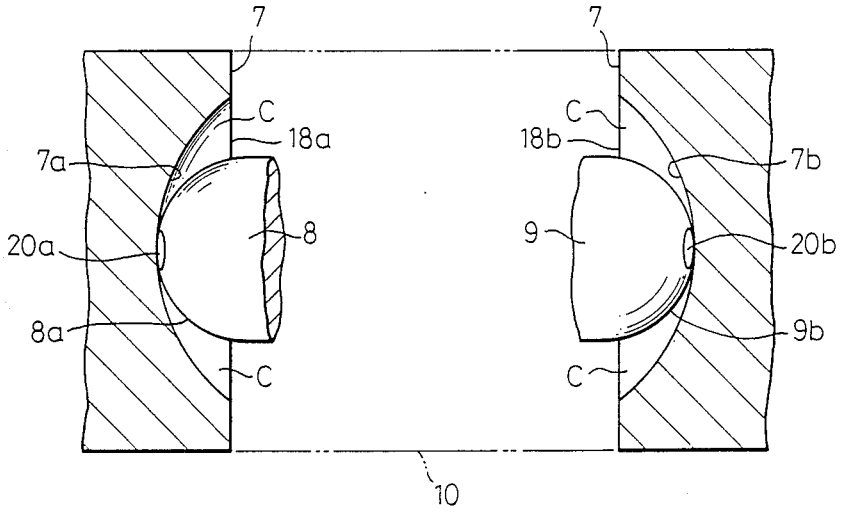
FIG. 3 is an enlarged cross sectional view of the shoe-and-socket joint taken along the line B—B of FIG. 1.

Referring to FIGS. 1 and 2, the each piston 10 is moved reciprocally forward and backward in each cylinder bore 11 via the spherical shoes 8 and 9, due to the rotation of the swash plate 5 in the direction of the arrow 22 in FIG. 2. During the operation, the spherical shoes 8, 9 are pressed into the ellipsoidal faces 7*a*, 7*b* respectively. In this embodiment, the major axis LA extends in the rotational direction of the swash plate 5, and thus wedge-shaped clearances C in the direction of the major axis exist up to the bottoms of the ellipsoidal faces 7*a*, 7*b* between the spherical contact faces 8*a*, 9*b* and the ellipsoidal faces 7*a*, 7*b*. Therefore, sufficient oil containing refrigerant gas in the swash plate chamber S enters the bottoms of the ellipsoidal faces 7*a*, 7*b* so that oil films are formed on the ellipsoidal faces 7*a*, 7*b* and the spherical contact faces 8*a*, 9*b* due to the oil mist component for lubrication in the refrigerant gas. Further, the oil component in the refrigerant gas flowing toward the direction 22 enters the clearances C so as to lift up the shoes 8, 9 from the bottoms of the ellipsoidal faces 7*a*, 7*b* of the shoes, as the wedge-shaped clearances C are formed in the rotational direction 22 of the swash plate 5. Consequently, sufficient oil is supplied into the bottoms of the shoes, and sufficient lubrication is achieved to ensure that abrasion and burning-in of the sliding contact faces between the shoes 8, 9 and the sockets is reduced.

In the embodiment, the length of the minor axis SA is substantially equal to the diameter D1 of the shoes 8, 9. That is, the spherical shoes 8, 9 fit and are held in the ellipsoidal faces 7*a*, 7*b*, in the radial direction of the swash plate 5. Accordingly, the noise due to the striking of the ellipsoidal faces 7*a*, 7*b* by the shoes 8, 9 is reduced.

In this embodiment, each of the spherical shoes 8, 9 has a flattened portion 20*a* or 20*b* formed at the apex thereof, to provide a cavity between the flattened portion 20*a* or 20*b* and the ellipsoidal face 7*a* or 7*b*. These cavities increase a contact area between the spherical contact faces 8*a*, 9*b* and the ellipsoidal faces 7*a*, 7*b*, and store the oil for lubrication. Therefore, the abrasion and the burning-in of the faces 7*a*, 7*b*, 8*a*, and 9*b* are further reduced.

Figure 4:
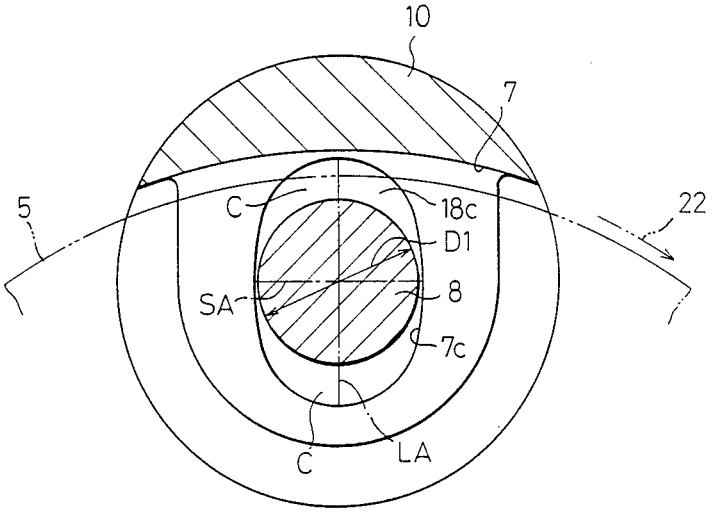
FIG. 4 is the enlarged cross sectional view of the shoe-and-socket joint according to a second embodiment of the present invention corresponding to FIG. 2.
Figure 5:
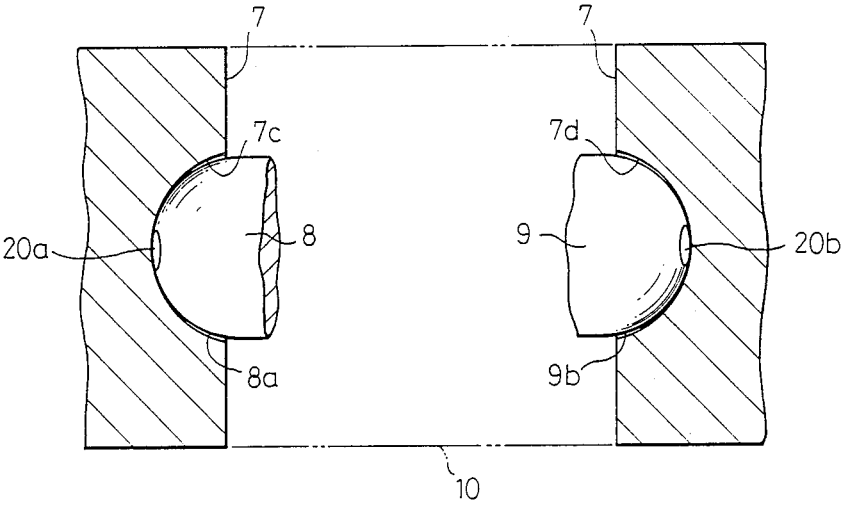
FIG. 5 is the enlarged cross sectional view of the shoe-and-socket joint according to the second embodiment of the present invention corresponding to FIG. 3.

The second embodiment of the present invention is shown in FIGS. 4 and 5. These sockets having the substantially ellipsoidal faces 7*c*, 7*d* and having the entrance opening 18*c* with a minor axis SA and a major axis LA are formed in the piston 10 for the minor axis SA so as to extend in the rotational direction 22 of the swash plate 5. The major axis LA extends at a right angle to the minor axis SA, and the length of the minor axis SA is substantially equal to the diameter D1 of the spherical shoe 8 (or 9). Therefore, the wedge-shaped clearance C is formed in the direction at a right angle to the rotational direction 22 of the swash plate 5. Also in this embodiment, sufficient oil containing refrigerant gas enters between the ellipsoidal faces 7*c*, 7*d* and the spherical faces 8*a*, 9*b*, to achieve a good lubrication.

From the foregoing description of the preferred embodiments of the present invention, it will be understood that, according to the present invention, the shoe-and-socket joint incorporated in a swash plate type compressor can be sufficiently lubricated by the oil-containing refrigerant during the operation of the compressor. Therefore, abrasion and burning-in of the shoes and the associated sockets is prevented, and the operational life of the compressor can be prolonged, and the noise due to the striking of the sockets by the shoes is reduced.

It should be understood that variations and modifications will occur to those skilled in the art within the scope and spirit of the present invention as claimed in the appended claims.

We claim:

1. A shoe-and-socket joint incorporated into a swash plate type compressor for transmitting an axial force from a rotating swash plate supported on a drive shaft to a piston of the compressor, which piston applies an axially reciprocal compression effect to a refrigerant containing a lubricating oil component within a cylinder bore of the compressor, comprising:

a shoe having a flat contact face in sliding contact with said swash plate and a spherical body provided with a substantially spherical contact face arranged opposite to said flat contact face; and, a socket having a recessed curved face deviated from a spherical face, and an entrance opening with a minor axis and a major axis, which recessed curved face is formed in said piston and in sliding contact with said substantially spherical contact face of said spherical body of said shoe.

2. A shoe-and-socket joint according to claim 1, wherein said piston is a double headed piston reciprocating in said cylinder bore, said piston having a central recess for permitting said swash plate to pass therethrough during rotating of said swash plate, and a pair of said sockets opposingly formed in said central recess, and wherein a pair of said shoes respectively having said substantially spherical contact face are slidably engaged in said pair of said sockets of said double headed piston.

3. A shoe-and-socket joint according to claim 1, wherein a length of said minor axis is substantially equal to a diameter of said spherical body.

4. A shoe-and-socket joint according to claim 1, wherein said substantially spherical contact face of said spherical body of said shoe is provided, at an apex thereof, with a flattened portion which defines a cavity for permitting said oil component of said refrigerant to flow between said spherical contact face of said shoe and said recessed curved face of said socket.

5. A shoe-and-socket joint according to claim 1, wherein said recessed curved face is a substantially ellipsoidal face formed in said piston and in sliding contact with said substantially spherical contact face of said spherical body of said shoe.

6. A shoe-and-socket joint according to claim 5, wherein said piston is a double headed piston reciprocating in said cylinder bore, said piston having a central recess for permitting said swash plate to pass therethrough during rotation of said swash plate, and a pair of said sockets opposingly formed in said central recess, and wherein a pair of said shoes respectively having said substantially spherical contact face are slidably engaged in said pair of said sockets of said double headed piston.

7. A shoe-and-socket joint according to claim 5, wherein a length of said minor axis is substantially equal to a diameter of said spherical body.

8. A shoe-and-socket joint according to claim 5, wherein said substantially spherical contact face of said spherical body of said shoe is provided, at an apex thereof, with a flattened portion which defines a cavity for permitting said oil component of said refrigerant to flow between said spherical contact face of said shoe and said ellipsoidal face of said socket.

9. A swash plate type compressor comprising a pair of horizontal axially aligned front and rear cylinder blocks to form a combined cylinder block; a swash plate rotatably mounted on a drive shaft rotatably supported in the center of said combined cylinder block, said swash plate being provided with opposite oblique faces inclined with respect to the axis of rotation of said swash plate; a swash plate chamber formed in the center of said combined cylinder block for rotatably receiving said swash plate therein and for receiving an oil-containing refrigerant returned from an outside refrigerating circuit; a plurality of cylinder bores axially extending through said combined cylinder block and equiangularly arranged around the central axis of said combined cylinder block; a plurality of double headed compressor pistons slidably fitted in said plurality of cylinder bores to compress the oil-containing refrigerant within said cylinder bores; and, a plurality of shoe-and-socket joints arranged between said opposite oblique faces of said swash plate and said plurality of said double-headed pistons, each of said shoe-and-socket joints comprising, a shoe having a flat contact face in sliding contact with one of said oblique faces of said swash plate and a spherical body provided with a substantially spherical contact face arranged opposite to said flat contact face; and, a socket having a recessed curved face deviated from a spherical face, and an entrance opening with a minor axis and a major axis, which recessed curved face is formed in each of said plurality of double headed compressor pistons and in sliding contact with said substantially spherical contact face of said spherical body of said shoe.

* * * * *